US011969111B2

(12) United States Patent
Banaszak

(10) Patent No.: US 11,969,111 B2
(45) Date of Patent: Apr. 30, 2024

(54) HANGER WITH TWO-PIECE, SPIRALED HOOK

(71) Applicant: Annie Banaszak, Johnson City, TN (US)

(72) Inventor: Annie Banaszak, Johnson City, TN (US)

( * ) Notice: Subject to any disclaimer, the term of this patent is extended or adjusted under 35 U.S.C. 154(b) by 0 days.

(21) Appl. No.: 17/805,893

(22) Filed: Jun. 8, 2022

(65) Prior Publication Data

US 2022/0395123 A1 Dec. 15, 2022

Related U.S. Application Data

(60) Provisional application No. 63/202,381, filed on Jun. 9, 2021.

(51) Int. Cl.
*A47G 25/34* (2006.01)
*A47G 25/30* (2006.01)

(52) U.S. Cl.
CPC ..... *A47G 25/34* (2013.01); *A47G 25/30* (2013.01)

(58) Field of Classification Search
CPC ..... A47G 25/00
See application file for complete search history.

(56) References Cited

U.S. PATENT DOCUMENTS 1,755,605 A * 4/1930 Knox ..... D06F 59/04 223/78
1,914,840 A * 6/1933 Wolff ..... A47G 25/32 24/555
1,973,376 A * 9/1934 Freedman ..... A47G 25/28 24/566
2,151,964 A * 3/1939 Gay ..... A47G 25/32 24/716
2,409,538 A * 10/1946 Brill ..... A47G 25/32 24/716
2,693,303 A * 11/1954 McGhie ..... A47G 25/32 223/85
3,458,093 A 7/1969 Bacharach
3,854,584 A 12/1974 Olson
4,155,493 A * 5/1979 Palmaer ..... A47G 25/32 223/88
4,805,816 A 2/1989 Freund
5,826,760 A 10/1998 Kolton et al.
6,158,633 A 12/2000 Schwab
6,595,355 B1 7/2003 Hooper
2007/0023370 A1 2/2007 Emery
2018/0184829 A1 7/2018 Raznick

FOREIGN PATENT DOCUMENTS

BR 202014021449 U2 * 6/2016 ..... A47F 7/08
CN 203074154 U * 7/2013 ..... A47F 7/08

* cited by examiner

*Primary Examiner* — Ismael Izaguirre
(74) *Attorney, Agent, or Firm* — Sheri Higgins; Sheri Higgins Law, PLLC

(57) ABSTRACT

A clothing hanger can include a solid body or substantially solid body. A top portion of the hanger can include a first and second curved portions that make up a rod opening and a hook opening. The body of the hanger can be solid or substantially solid and include one or more cutouts for hanging pants, skirts, scarves, or ties. The two curved portions and the solid or substantially solid body can prevent the hooks of the hanger from becoming entangled with other hangers.

20 Claims, 2 Drawing Sheets

HANGER WITH TWO-PIECE, SPIRALED HOOK

TECHNICAL FIELD

The field relates to a hanger for hanging clothes. The hanger has a two-piece, spiraled hook and a solid body.

BRIEF DESCRIPTION OF THE FIGURES

The features and advantages of the embodiments will be more readily appreciated when considered in conjunction with the accompanying figures. The figures are not to be construed as limiting any of the embodiments.

DETAILED DESCRIPTION

Hangers are used to hang clothing items, such as shirts, sweaters, blouses, pants, dresses, skirts, scarves, etc., instead of the clothing items being folded. Hangers typically include a thin frame that forms a hollow body and a hook. The frame can have a thickness in the range from 1/32 inch to 1/2 inch. The frame can be made of metals, metal alloys, hardened plastics, or other materials. When the frame is made of metals or metal alloys, the hanger can include a cardboard tube located on the bottom of the hanger to prevent creases in pants. The hook is used to hang the hanger onto a rod, such as rod in a closet or a portable clothing rack. The hook is typically a thin arched piece of metal or metal alloy with a single opening—typically about 1/32 to 1/16 inch thick. It is common for the hook to rotate or swivel in relation to the frame.

There are several disadvantages to hangers currently on the market. First, because the hooks are formed from a single piece of material that forms a question mark shaped hook opening, it is very easy for one hook to overlap and hook onto another hook on a rod instead of being hooked onto the rod. This prevents the hangers from being moved along the rod to view the clothing items more easily on the hangers because the hooks get tangled up with each other. Another more significant disadvantage is empty hangers (i.e., hangers without clothes) get tangled up with each other when not hung on a rod. For example, if one has ever moved and placed empty hangers in a bag for transport, they know how easily the hangers can get tangled up with each other. The hangers easily get tangled into a massive jumble (depending on how many hangers are placed in the bag) because the hooks get tangled with other hooks and hooks get tangled up in the hollow body defined by the frame. Getting tangled is not just limited to moving or placing empty hangers in a bag for transport, it also occurs when placing empty hangers together on the floor or in a drawer for storage. Trying to untangle hangers is not only time consuming but can also be extremely frustrating. Thus, there is a long-felt need for hanger hooks that cannot overlap each other on a rod and hangers that do not get tangled together when not being used.

It has been discovered that a hanger can include a two-piece hook and a solid body or substantially solid body. The two-piece hook prevents the hooks from overlapping each other on a rod. Moreover, the two-piece hook and the solid or substantially solid body prevent the hangers from getting tangled up with each other when not in use.

According to any of the embodiments, a clothing hanger comprises: a body; and a top portion, wherein the top portion comprises: a first curved portion; a second curved portion; a rod opening formed from the first curved portion and the second curved portion; and a hook opening formed from the second curved portion.

Figure 1:
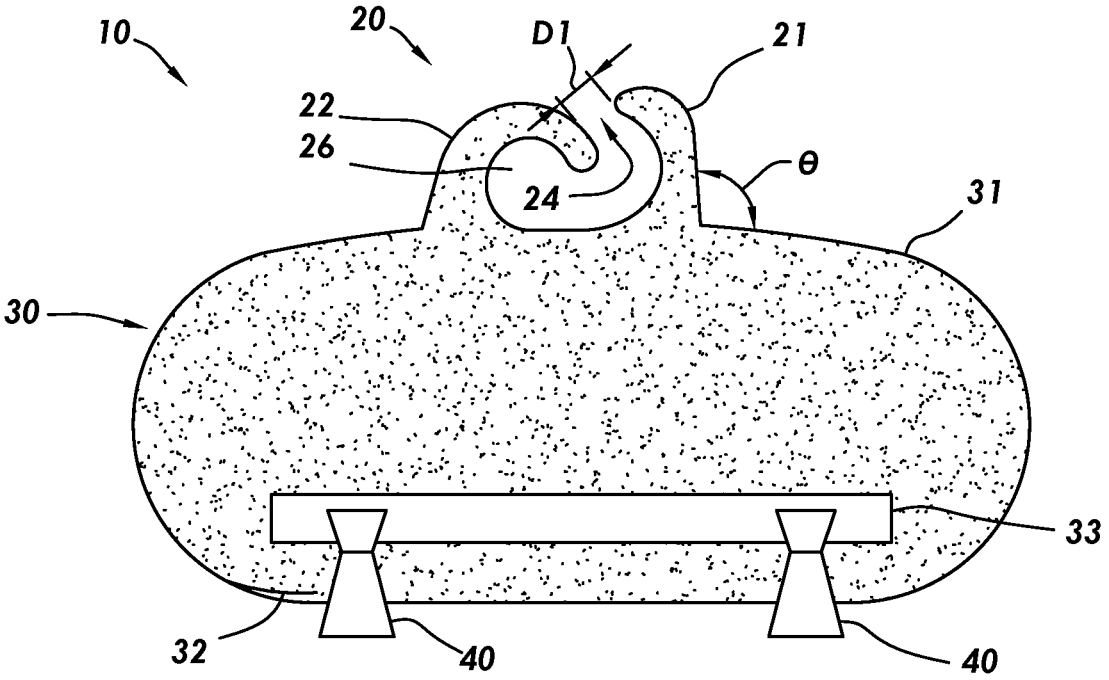
FIG. 1 is a front view of a hanger having a cutout for pants according to certain embodiments.
Figure 2:
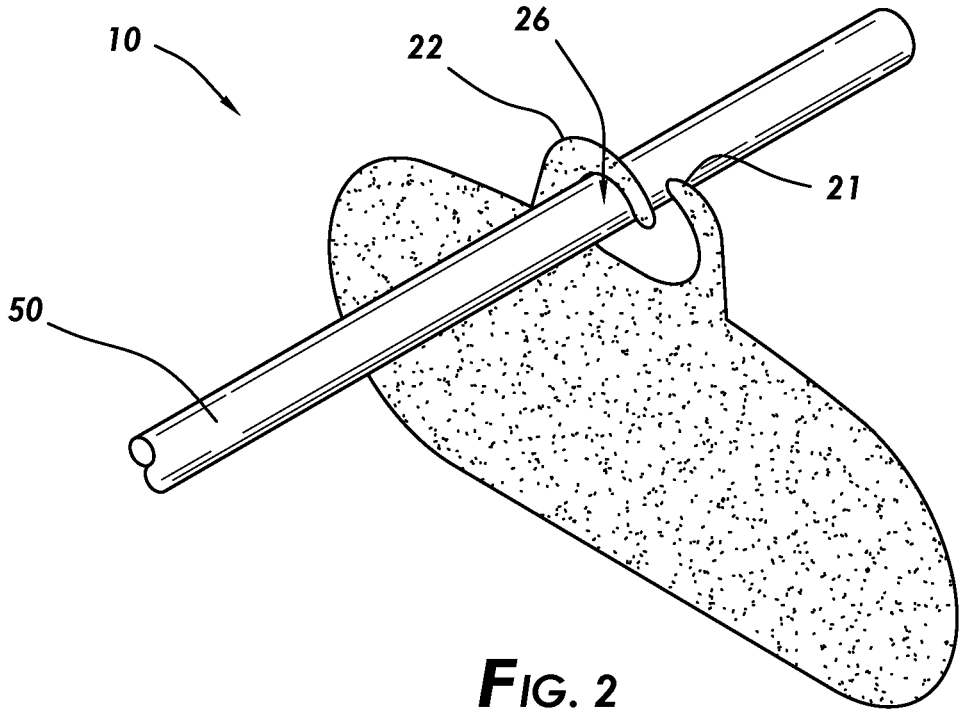
FIG. 2 is a front perspective view of a hanger on a rod according to certain embodiments.
Figure 5:
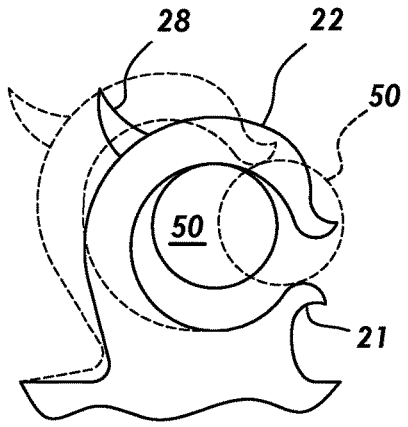
FIG. 5 is a front view of a top portion of the hanger of FIG. 4 on a rod.

FIG. 1 is a front view of the hanger 10 according to certain embodiments. The hanger 10 can include a top portion 20, a left and right shoulder portions 31, a body 30, and a bottom portion 32. The top portion 20 of the hanger 10 is used to hang the hanger onto a rod 50, for example as shown in FIGS. 2 and 5. The top portion 20 of the hanger 10 can include a two-piece hook. The top portion 20 can include a first curved portion 21 located adjacent to a second curved portion 22. According to any of the embodiments, the top portion 20 is integrally formed with the body 30 of the hanger 10. In this manner, the top portion 20 is inhibited or prevented from swiveling or rotating in relation to the body 30.

Figure 3:
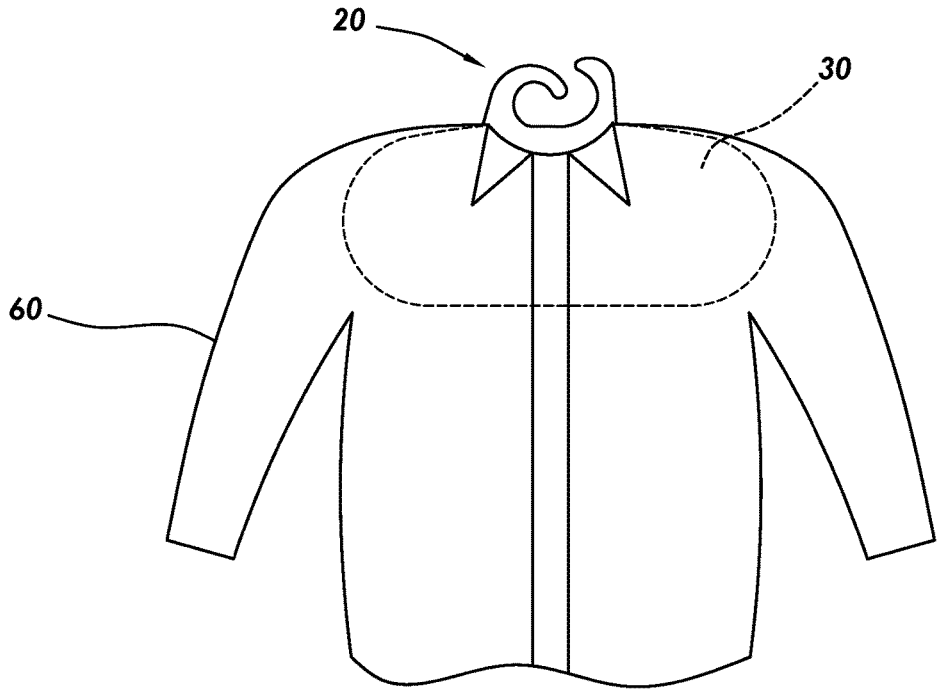
FIG. 3 is a front view showing a clothing item hung on the hanger according to certain embodiments.

With reference to FIGS. 1-3, the first curved portion 21 can include a curved top and a slightly curved to straight outside edge. The second curved portion 22 can include a curved top and a slightly curved to straight outside edge. Straighter outside edges can form an angle θ of approximately 90° at the junction with the left and right shoulder portions 31 (for example as shown in FIG. 1) and can be useful for collared shirts, or turtleneck or cowl neck tops or sweaters. The angle θ can also be greater than or less than 90°.

With reference to the figures, a rod opening 24 can be formed from the first curved portion 21 and the second curved portion 22. The curved inside edges of the first and second curved portions 21/22 can form the rod opening 24. A hook opening 26 can be formed by the curved, inside edge of the second curved portion 22 and can be centrally aligned with the width of the body 30 of the hanger. A rod 50 can be located within the hook opening 26 after the hanger 10 is placed on the rod 50. A centrally aligned hook opening 26 can help ensure that neither the left nor the right shoulder portions 31 tilt away from the rod 50 and cause clothing to be askew. The height and width of the hook opening 26 can be selected such that a rod 50 can be placed within the hook opening 26. By way of example, if the rod 50 has an outer diameter of 2 inches, then the height and width of the hook opening 26 can be 2.5 inches. The hook opening 26 can have a height and width in the range of 1.5 inches to 4 inches. The height and the width of the hook opening 26 can be the same or different. For example, the width of the hook opening 26 can be greater than the height.

A rod opening 24 can be defined between the inside edge of the first curved portion 21 and the curved top of the second curved portion 22. According to any of the embodiments, the rod opening 24 is located at the top of the top portion 20 opposite from the bottom portion 32 of the body 30. The distance D1 of the rod opening 24 can vary and can be selected based on the outer diameter of a rod 50. By way of example, for a rod 50 having an outer diameter of 2 inches, the distance D1 of the rod opening 24 can be greater than or equal to 2 inches. In this manner, there is enough clearance for the rod 50 to fit through the rod opening 24 and for the top portion 20 of the hanger to be placed on the rod 50 to hang the hanger 10 as shown in FIG. 2. By way of another example, the first curved portion 21, the second curved portion 22, or both the first and second curved portions 21/22 can be made from a flexible material. According to this example, the distance D1 of the rod opening 24 can be less than the outer diameter of the rod 50. During placement of the hanger 10 onto the rod 50, the first and/or second curved portions can flex, thereby increasing the distance D1 of the rod opening 24 to allow the rod 50 to pass through the rod opening 24.

In order to hang the hanger 10 onto a rod 50, a user would hold the body 30 of the hanger in hand and navigate the top portion 20 onto the rod 50 by inserting the rod opening 24 onto the rod, continue with an upward/left movement in relation to the rod, move the hanger to the right when the rod reaches the bottom of the second curved portion 22, and then move the hanger down to place the rod 50 into the hook opening 26.

Figure 4:
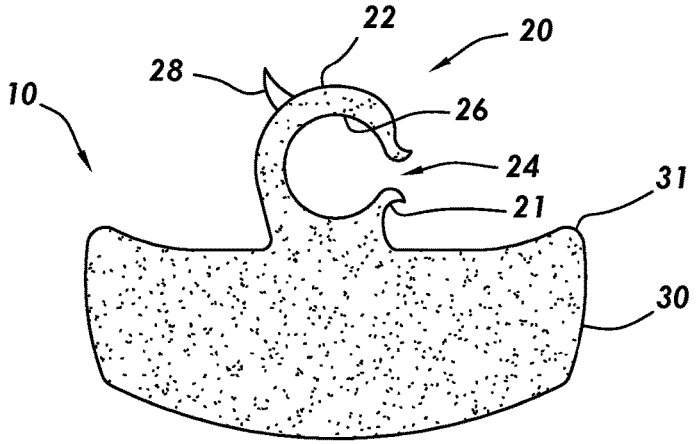
FIG. 4 is a front view of a hanger according to certain other embodiments.

With reference to FIGS. 4 and 5, the second curved portion 22 can be located adjacent to the first curved portion 21 such that the rod opening 24 is located at a side of the top portion 20 instead of at the top of the top portion 20 like the embodiment shown in FIG. 1. The inside of the first and second curved portions 21/22 can form a generally circular hook opening 26 instead of a spiraled hook opening as shown in FIG. 1. The top portion 20 can also include a thumb tab 28 located opposite of the rod opening 24. The thumb tab 28 can have straight edges or can be curved. In order to hang the hanger 10 onto a rod 50, a user would hold the body 30 of the hanger 10 in hand, optionally place the thumb of the hand onto the top of the thumb tab 28 if included, and push the first and second curved portions 21/22 into engagement with the outside of the rod 50, and continue pushing the hanger 10 towards the rod until the rod is positioned within the hook opening 26. The thumb tab 28 can also be used in removing the hanger from the rod 50. A user can apply a downward pressure to the thumb tab 28 in order to increase the distance D1 of the first and second curved portions 21/22 and move the hanger away from the rod 50.

According to any of the embodiments, the width of the first curved portion 21 and the second curved portion 22 when viewing the hanger from the front is in the range of 0.5 to 1 inch. In this manner, the top portion having two separate curved portions that form a hook and having a width in the disclosed range will substantially inhibit or prevent the hook from becoming entangled with each other on a rod and the bodies of other hangers when not on a rod. According to any of the embodiments, the dimensions of the top portion and the hook opening 26 can be selected based on the outer diameter of the rod 50 and the type of garment to be hung on the hanger. By way of example, the height of the top portion 20 may be increased to accommodate garments, such as a turtleneck or collared shirt, such that the top of the garment does not make contact with the bottom of the rod 50. For non-collared shirts, such as T-shirts or blouses, the height of the top portion 20 can be decreased because the top of the garment would not come into contact with the bottom of the rod 50.

According to any of the embodiments and as discussed above, the distance D1 (not labeled in FIGS. 4 and 5) of the rod opening 24 can be less than the outer diameter of the rod 50 depending on the material the hanger is made from. For example, for cardboards or other flexible or semi-flexible materials, one could push the first curved portion 21 of FIG. 1 away from a plane of the body 30 or the first and second curved portions 21/22 of FIG. 5 can move away from each other to increase the distance D1 of the rod opening 24 in order for the rod 50 to traverse through the rod opening 24. For non-flexible materials, the distance D1 of the rod opening 24 can be greater than or equal to the outer diameter of the rod to be used.

The hanger can include left and right shoulder portions 31. The right shoulder portion is labeled in FIG. 1. The left and right shoulder portions 31 can correspond to the shoulder sections of a shirt or top 60 when the shirt or top 60 is placed on the hanger 10, for example as shown in FIG. 3. The left and right shoulder portions 31 can be substantially straight as shown in FIG. 1, can curve slightly down towards the bottom portion 32 of the hanger 10 as shown in FIG. 3, or can curve slightly up towards the top portion 20 as shown in FIG. 4. The left and right shoulder portions 31 can also include straight sections and curved sections. By way of example, a section of the shoulder portions extending from the top portion 20 can be straight, while a section of the shoulder portions located at the edges can be tapered or angled. Inclusion of a downward curved section can reduce undesirable stretching of clothing at the shoulder/sleeve interface or sleeve when the clothing is placed on the hanger. Inclusion of an upward curved section can help keep clothing from undesirably slipping off the hanger after the clothing is placed on the hanger.

The hanger 10 includes a body 30. The body 30 can be completely solid, for example, as shown in FIGS. 2-4 or can be substantially solid, for example as shown in FIG. 1. As used herein, the term "substantially solid" means at least 70% of the body is solid but can include one or more cutouts in the body and is meant to exclude a hollow body that is defined by a frame. A substantially solid body 30 can include one or more cutouts 33. The one or more cutouts 33 can have a variety of geometric shapes and have a variety of dimensions. As shown in FIG. 1, the cutout can have a length greater than its height. This may be useful to hang pants, ties, or scarves. The cutout 33 of FIG. 1 has a length spanning almost the entire length of the bottom portion 32 of the hanger 10. However, there can also be 2 cutouts 33 positioned adjacent to each other that have a length that does not span a majority of the length of the bottom portion 32. The one or more cutouts 33 can also be square in shape. The one or more cutouts 33 can be located on different areas of the body 30, for example near the top portion 20, the bottom portion 32, the sides, or combinations thereof. The one or more cutouts 33 can be configured to receive a clip 40. One or more clips 40 can then be attached to the one or more cutouts 33, for example, as shown in FIG. 1. The use of clips 40 may be useful to hang pants or skirts (i.e., clothing that doesn't have shoulders) vertically at the waistband instead of folding the pants to hang through the cutout. The one or more cutouts 33 can have a length in the range of 0.5 inches to 12 inches. The one or more cutouts 33 can have a height in the range of 0.5 inch to 5 inches.

The body 30 can have a variety of shapes and dimensions. By way of example, the body 30 can have a generally circular, rectangular, or elliptical shape. According to any of the embodiments, the body 30 has a width that is greater than its height, wherein the height is defined as the distance between the bottom portion 32 and top portion 20. The width of the hanger 10 can vary and can be selected to provide different sizes of hangers (e.g., youth, small, medium, large, extra-large, etc.). By way of example, the width of the hanger can be selected to correspond to a width of a clothing top. The width of a T-shirt for a toddler for example will be less than the width for an adult size large. In this manner, undesirable stretching of the fabric of a clothing top is reduced or eliminated. The height of the hanger from the bottom portion 32 to the top portion 20 can also vary. According to any of the embodiments, the hanger 10 can have a width and height in the range of 5 to 15 inches.

The hanger 10 can have a thickness when viewing the hanger 10 from the side. The thickness of the hanger 10 can range from 0.25 to 1 inch. According to any of the embodiments, the thickness of the top portion 20 is the same as the thickness of the body 30. The exterior edges of the hanger when viewed from the side can be straight, that is form a 90° angle, or curve from the middle towards the front of the hanger and curve from the middle towards the back of the hanger. Curved exterior edges can also reduce wrinkles to clothes when being hung on the hanger. If the hanger 10 also includes one or more cutouts 33, then the edges of the cutouts can also be straight or curved. Curved edges of the cutouts can prevent creases to pants or skirts that are folded and inserted through the cutout.

The bottom portion 32 can be curved like a half circle or half oval or substantially straight as shown in FIG. 1. Substantially straight means that the majority (i.e., greater than 50%) of the referenced element is straight. A substantially straight element can include curved ends. By way of example, the ends of the bottom portion 32 that conjoin with the sides of the body 30 can be greater than 90°.

FIGS. 2 and 5 show the hanger 10 after placement onto a rod 50 with the hanger 10 supported by the rod 50 within the hook opening 26. As discussed above, a user can position the hanger 10 onto the rod 50 by moving the top portion 20 in relation to the fixed rod such that the rod 50 traverses through the rod opening 24 and then into the hook opening 26. FIG. 3 is an illustrative example of a clothing top 60, which is a collared, button-up shirt, being hung on the hanger 10. As can be seen in FIG. 3, the top portion 20 of the hanger 10 can protrude from the neck of the shirt and be placed on a rod 50.

The hanger 10 can be made from a variety of materials, including but not limited to, cardboard, reinforced cardboard, cellulose, reinforced cellulose, hardened plastics, semi-rigid plastics, metals, metal alloys, silicone materials, and combinations thereof. According to any of the embodiments, the body 30 and the top portion 20 are made from the same material and the top portion 20 is integrally formed with the body 30 as a single unit. In this manner, the first curved portion 21 and the second curved portion 22 do not rotate or move in relation to a plane of the body 30. All or a portion of the hanger 10, such as the left and right shoulder portions 31, can further include a layer of non-slip material exterior to the material making up the hanger. The layer of non-slip material can be, for example, velvet, velveteen, natural silk, cotton, polymeric, non-woven fabrics, silicone materials, or rubbers. This can help the clothing item stay on the hanger easier and can also prevent creases.

The hanger 10 can also include other elements. By way of example, the top portion 20 can include one or more holes or cutouts for removably securing earrings, scarves, belts, etc. to the hanger 10. By way of another example, a second top portion (not shown) can be included. The second top portion can include: a second, first curved portion; a second, second curved portion; a second rod opening; and a second hook opening. The second top portion can be located opposite of the top portion 20 or on a side of the hanger adjacent to the top portion 20. There can also be more than two top portions located at a variety of locations of the hanger. Additionally, because the body 30 of the hanger 10 can be solid or substantially solid, there is surface area in which designs can be placed. A design, for example a drawing of an animal, can be applied to the body via an applique or paint or other means of application. The design can be any kind of design and can be appropriately selected for children's hangers or adult hangers with a variety of themes.

Therefore, the apparatus, methods, and systems of the present disclosure are well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present disclosure.

As used herein, the words "comprise," "have," "include," and all grammatical variations thereof are each intended to have an open, non-limiting meaning that does not exclude additional elements or steps. While the apparatus, systems, and methods are described in terms of "comprising," "containing," or "including" various components or steps, the apparatus, systems, and methods also can "consist essentially of" or "consist of" the various components and steps. It should also be understood that, as used herein, "first," "second," and "third," are assigned arbitrarily and are merely intended to differentiate between two or more curved portions, etc., as the case may be, and does not indicate any sequence. Furthermore, it is to be understood that the mere use of the word "first" does not require that there be any "second," and the mere use of the word "second" does not require that there be any "third," etc.

Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A clothing hanger comprising:

a body, wherein the body is substantially solid, and wherein the body comprises a left shoulder portion and a right shoulder portion; and a top portion, wherein the top portion comprises:

a first curved portion;

a second curved portion;

a rod opening formed from the first curved portion and the second curved portion; and a hook opening formed from the second curved portion, wherein the entire hook opening is located above the left shoulder portion and the right shoulder portion.

2. The clothing hanger according to claim 1, wherein the top portion is integrally formed with the body of the hanger.

3. The clothing hanger according to claim 1, wherein the first curved portion and the second curved portion comprise a curved top and a curved or straight outside edge.

4. The clothing hanger according to claim 3, wherein the outside edge of the first curved portion conjoins with the right shoulder portion and forms a first angle, and wherein the outside edge of the second curved portion conjoins with the left shoulder portion and forms a second angle.

5. The clothing hanger according to claim 4, wherein the first and second angles are in a range from 90° to 170°.

6. The clothing hanger according to claim 1, wherein the first and second curved portions comprise curved inside edges, and wherein the curved inside edges form the hook opening.

7. The clothing hanger according to claim 6, wherein the curved inside edges are spiral shaped.

8. The clothing hanger according to claim 6, wherein the curved inside edges are circular shaped.

9. The clothing hanger according to claim 1, wherein the hook opening is centrally aligned with a width of the body.

10. The clothing hanger according to claim 1, wherein the hook opening is configured to receive a rod after the clothing hanger is placed on the rod.

11. The clothing hanger according to claim 10, wherein a height and width of the hook opening is selected such that the rod can be placed within the hook opening.

12. The clothing hanger according to claim 1, wherein a distance of the rod opening is greater than the outer diameter of a rod.

13. The clothing hanger according to claim 1, wherein the rod opening is located at a top of the top portion that is opposite from a bottom portion of the body.

14. The clothing hanger according to claim 1, wherein the rod opening is located at a side of the top portion.

15. The clothing hanger according to claim 1, further comprising a thumb tab located on the top portion.

16. The clothing hanger according to claim 1, wherein the left and right shoulder portions are straight, curve down away from the top portion, curve slightly up towards the top portion, or include both straight areas and curved areas.

17. The clothing hanger according to claim 1, wherein the body is solid.

18. The clothing hanger according to claim 1, further comprising one or more cutouts located on the body.

19. The clothing hanger according to claim 1, wherein the clothing hanger made from a material selected from cardboard, reinforced cardboard, cellulose, reinforced cellulose, hardened plastics, semi-rigid plastics, metals, or metal alloys.

20. The clothing hanger according to claim 19, wherein all or a portion of the left and right shoulder portions comprise a layer of non-slip material exterior to the material making up the hanger.

* * * * *